US009558684B2

(12) United States Patent
Poelker et al.

(10) Patent No.: US 9,558,684 B2
(45) Date of Patent: Jan. 31, 2017

(54) CABLE MARKER

(71) Applicant: Phoenix Contact GmbH & Co. KG, Blomberg (DE)

(72) Inventors: Thomas Poelker, Horn-Bad Meinberg (DE); Joachim Jacke, Bad Driburg (DE); Manuela Paus, Schieder-Schwalenberg (DE); Miguel Delgado-Abracos, Doerentrup (DE); Bastian Meisenberg, Paderborn (DE); Sandra Klocke, Vlotho (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/917,023

(22) PCT Filed: Aug. 8, 2014

(86) PCT No.: PCT/EP2014/067089

§ 371 (c)(1),
(2) Date: Mar. 7, 2016

(87) PCT Pub. No.: WO2015/032589

PCT Pub. Date: Mar. 12, 2015

(65) Prior Publication Data

US 2016/0196771 A1 Jul. 7, 2016

(30) Foreign Application Priority Data

Sep. 9, 2013 (DE) ..... 10 2013 109 837

(51) Int. Cl.
*G09F 3/20* (2006.01)

(52) U.S. Cl.
CPC ..... *G09F 3/205* (2013.01); *G09F 3/201* (2013.01)

(58) Field of Classification Search
CPC ..... G09F 3/0295; G09F 3/205; G09F 3/201
See application file for complete search history.

(56) References Cited

U.S. PATENT DOCUMENTS 4,033,057 A * 7/1977 Jaffe ..... G09F 3/08 40/316
4,656,767 A * 4/1987 Tarrant ..... G09F 3/04 174/112

(Continued)

FOREIGN PATENT DOCUMENTS

DE 4404590 A1 8/1995
DE 19738878 A1 3/1999

(Continued)

OTHER PUBLICATIONS

Weidmüller Interface GmbH & Co. KG: "Systemised marking Accompanying marker variants", Apr. 2012 (Apr. 2012), XP002731740, retrieved from the internet: URL: http://cmswebdav.weidmueller.de/cms/gu_uk/Downloads/Print_Literature/Product%20Information%20Brochures/Marking%20Systems/1363670000_SystemisedMarkingAccompanyingMarkerVarients.pdf, p. 10.

(Continued)

*Primary Examiner* — Gary Hoge
(74) *Attorney, Agent, or Firm* — Leydig, Voit & Mayer, Ltd.

(57) ABSTRACT

A cable marker includes a housing which has an accommodating opening to accommodate a label to mark a cable, a cover to close the accommodating opening in a closed position of the cable marker, and a film hinge integrally connecting the housing to the cover such that in an open position, in which the cover does not close the accommodating opening, the cover can be pivoted in relation to the housing along a pivoting plane. The film hinge has a first base portion connecting the film hinge to the housing, a (Continued)

second base portion connecting the film hinge to the cover, and a connecting portion arranged between the first base portion and the second base portion. The connecting portion has a width that is reduced in comparison with at least one of the base portions as viewed in a direction perpendicular to the pivoting plane.

16 Claims, 6 Drawing Sheets

(56) References Cited

U.S. PATENT DOCUMENTS

| | | | | |
|---|---|---|---|---|
| 5,115,586 | A * | 5/1992 | Hawker | G02B 6/4482 40/316 |
| 6,928,761 | B2 * | 8/2005 | Frappell | B42F 21/06 40/641 |
| 8,516,727 | B1 * | 8/2013 | Maraia | G09F 3/205 40/316 |
| 2010/0000132 | A1 | 1/2010 | Maier-Hunke | |
| 2011/0005110 | A1 * | 1/2011 | Wieneke | G09F 3/06 40/316 |
| 2013/0263482 | A1 * | 10/2013 | Strater | G09F 3/205 40/316 |

FOREIGN PATENT DOCUMENTS

| | | | |
|---|---|---|---|
| DE | 102005046468 | A1 | 4/2007 |
| DE | 102006017613 | A1 | 10/2007 |
| DE | 202010002852 | U1 | 6/2010 |
| DE | 102009014694 | A1 | 10/2010 |
| EP | 0658867 | A2 | 6/1995 |
| GB | 2214892 | A | 9/1989 |

OTHER PUBLICATIONS

Weidmueller Interface GmbH & Co. KG: "Kabelmarkierer WKM Aug. 30", Mar. 27, 2012 (Mar. 27, 2012), XP055149359, retrieved from the internet: http://test0026.automation.ajayapra.org/Web/Downloads/_t/ds/1631910000_ger_tds.pdf?mime=application/pdf, whole document.

* cited by examiner

B-B

C-C

A-A

B-B

C-C

CABLE MARKER

CROSS-REFERENCE TO PRIOR APPLICATIONS

This application is a U.S. National Phase application under 35 U.S.C. §371 of International Application No. PCT/EP2014/067089, filed on Aug. 8, 2014, and claims benefit to German Patent Application No. DE 10 2013 109 837.1, filed on Sep. 9, 2013. The International Application was published in German on Mar. 12, 2015 as WO 2015/032589 A1 under PCT Article 21(2).

FIELD

The invention relates to a cable marker.

BACKGROUND

A cable marker may include a housing, which has an accommodating opening for accommodating a label for marking a cable. A cover can be attached to the housing in order to close the accommodating opening in a closed position. The cover is integrally connected to the housing by means of a film hinge in such a way that in an open position, in which the cover does not close the accommodating opening, the cover can be pivoted in relation to the housing along a pivoting plane.

A cable marker of this type is used to label a cable. A label, for example a tag, a labeling strip or similar, can be attached to a cable by means of such a cable marker. The label is inserted into the accommodating opening of the housing for this purpose, whereupon the housing is closed by the cover and the cable marker is attached to the cable in the closed position.

A cable marker of this type is known, for example, from DE 197 38 878 A1. In this case, the cable marker in DE 197 388 78 A1 has fastening lugs on a housing on the one side and on a cover on the other side, by means of which the cable marker can be fixed to an associated cable, for example by means of a cable tie.

In the case of a cable marker known from DE 10 2006 017 613 A1, a housing has insertion openings into which an identification label can be inserted and which can be closed by means of end caps.

A name tag with a front part and a rear part is known from DE 10 2005 046 468 A1, where the front part and the rear part constitute a receptacle for a labeling card.

A cable marker of the type in question here has a viewing surface, for example on the housing, through which a label inserted into the accommodating opening of the housing is visible from the outside. So that information on the label is easily legible in the process, it is necessary for the cable marker, which is produced, for example, integrally with its housing and cover from a plastics material, to be sufficiently see-through at least at its viewing surface. At the same time, the cable marker must be flexible in particular in the region of its film hinge such that the cover can be attached to the housing readily by bending the film hinge without the film hinge being destroyed in the process.

Conventional cable markers of this kind are, for example, produced integrally from a flexible plastics material based on polyethylene (PE), which has a modulus of elasticity of 260 MPa, for example. While such cable markers are frequently see-through, they do appear milky in the process, i.e. they only have limited transparency.

A cable marker of the type in question here should be usable outside, for example, or in environments in which there are increased fire prevention requirements. Due to changing weather conditions there are increased loads outside, which make particular demands on the material of the cable marker, caused for example by UV irradiation or contact with water. In environments where there are increased fire prevention requirements, it is absolutely necessary for the cable marker to be produced from a non-flammable/not highly flammable material.

SUMMARY

In an embodiment, the present invention provides a cable marker including: a housing which has an accommodating opening to accommodate a label for marking a cable; a cover to close the accommodating opening in a closed position of the cable marker; and a film hinge integrally connecting the housing to the cover such that in an open position, in which the cover does not close the accommodating opening, the cover is pivotable in relation to the housing along a pivoting plane. The film hinge has a first base portion connecting the film hinge to the housing, a second base portion connecting the film hinge to the cover, and a connecting portion arranged between the first base portion and the second base portion. The connecting portion has a width that is reduced in comparison with at least one of the base portions as viewed in a direction perpendicular to the pivoting plane.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1B:
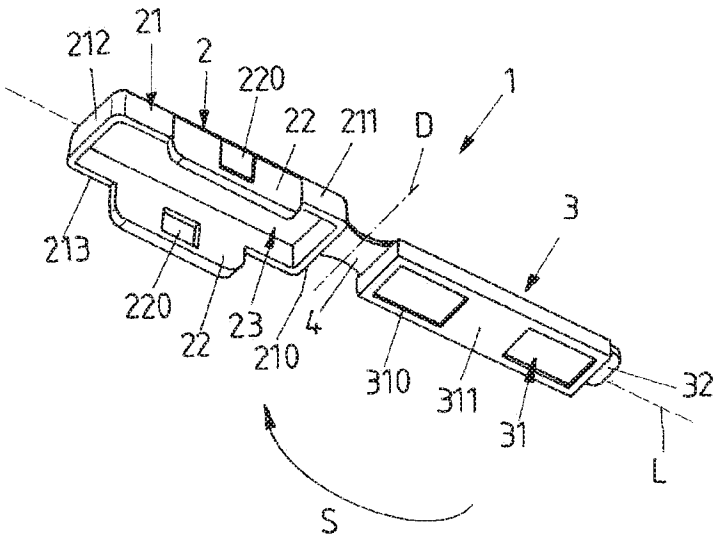
FIG. 1B is another perspective view of the cable marker.

There is therefore a need for cable markers which can be handled in a convenient manner where the cover can be pivoted in a simple manner towards the housing and can be opened again from its closed position, which also have good transparency and, moreover, can meet the necessary requirements, for example with regard to resistance to weather or fire prevention.

In this context, there is the difficulty that transparent materials, which also have good resistance to weather or can meet increased fire prevention requirements, frequently have reduced flexibility and therefore a simple substitution of materials in existing cable markers is not readily possible. Moreover, some plastics materials absorb relatively large amounts of water and can become brittle as a result of water release, which can lead to greater susceptibility to breaking and therefore makes the formation of film hinges difficult.

According to the invention, the film hinge has a first base portion, by means of which the film hinge is connected to the housing, a second base portion, by means of which the film hinge is connected to a cover, and a connecting portion arranged between the first base portion and the second base portion, the connecting portion having a width that is reduced in comparison with at least one of the base portions as viewed in a direction perpendicular to the pivoting plane.

The present invention is based on the knowledge that a simple substitution of materials, in particular to provide a highly transparent cable marker, which is optimised for a specific application as regards its material, is not readily possible. A plastics material, for example polycarbonate, which has a high transparency and in particular does not appear milky and also meets requirements for increased fire prevention, for example in interior applications such as in rail vehicles, has increased rigidity, which requires an adjustment with a view to the cable marker in particular in order to form the film hinge. Accordingly within the meaning of the present invention, the film hinge is formed in a tapered manner such that it has a reduced width (viewed in a direction perpendicular to the pivoting plane) in an internal portion between the two connection points to the housing on the one side and to the cover on the other side. Starting from a base portion, by means of which the film hinge is connected to the housing or to the cover, the film hinge therefore becomes narrower such that a defined bending line or a defined bending region is provided on the connecting portion between the base portions where the film hinge can be bent in a simple, flexible manner due to its reduced width.

The present invention therefore makes possible the use of a highly transparent, comparatively rigid plastics material for producing the cable marker without the functionality of the film hinge being impaired as a result.

The width of the connecting portion is reduced in comparison with at least one of the two base portions. A design is feasible in the process where the width reduces, starting from one of the base portions, and then does not widen again towards the other base portion. Preferably the connecting portion is, however, tapered such that the width of the connecting portion is smaller than the width of both the first base portion, by means of which the film hinge is connected to the housing, and of the second base portion, by means of which the film hinge is connected to the cover. If the connecting portion is additionally designed to be curved on at least one of its edges which extend between the first base portion and the second base portion, a tapering of the film hinge arises with a preferred bending line at the location of the smallest width of the connecting portion. In the process, the curvature of at least one of the edges of the connecting portion can, for example, be described by a constant finite radius of curvature such that the connecting portion has a convex indentation at least in portions.

Specifically, the ratio of the narrowest width of the connecting portion to the width of the at least one base portion in relation to which the width of the connecting portion is reduced can be between 50% and 90%, preferably between 65% and 85%, for example between 70% and 80%. If the width of the at least one base portion is 100% then the width of the connecting portion at its narrowest point is therefore reduced to a value between 50% and 90% of the width of the at least one base portion.

The housing preferably has a viewing surface and a front wall angled towards the viewing surface. In the region of the viewing surface, a label, for example a tag or similar, inserted into the accommodating opening of the housing comes to lie such that the label is visible through the viewing surface. In the process, the film hinge is arranged with its first base portion on the front wall of the housing such that a connection to the cover is provided by means of the front wall and the film hinge attached to it.

Preferably, the front wall has a first edge and a second edge located opposite the first edge. The front wall is connected to the viewing surface along the second edge. The second edge therefore forms the location at which the front wall that is angled towards the viewing surface transitions into the viewing surface. The first edge is opposite the second edge and is therefore located away from the second edge. In the process, the first base portion connected to the front wall at a connection point between the first edge and the second edge such that the connection of the film hinge to the front wall is at a location between the first edge and the second edge, but not directly on one of the edges.

This has two advantages. Because the film hinge is not directly attached to one of the edges, firstly the formation of a predetermined breaking point at the connection point of the film hinge to the front wall is prevented. Secondly, because the film hinge is connected to the front wall at a connection point between the first edge and the second edge, the bending of the film hinge in the closed position of the cable marker is reduced because when the cover is pivoted to close the cable marker, the film hinge has to be conducted around the first edge. Because the connection point at which the film hinge is connected to the front wall is distanced from this first edge, a relatively large bending radius of the film hinge arises in the closed position, which in particular can reduce the susceptibility of the film hinge to breaking.

In a specific embodiment, the connection point at which the film hinge is attached to the front wall can be arranged, for example, at the same distance from the first edge and from the second edge. The connection point is therefore central between the first edge and the second edge.

To transfer the cover into the closed position, the cover is pivoted about the first edge of the front wall. In the process, it has emerged that preferably the ratio between the distance from the connection point to the first edge and the longitudinal extension of the film hinge between the housing and the cover is advantageously selected in a specific manner in order, on the one hand, to allow a convenient, easy pivotabilty and, on the other hand, to reduce the risk of a fracture on the film hinge as far as possible. The ratio between the longitudinal extension and the distance is therefore advantageously set at a value between 2 and 4, preferably between 2.5 and 3.5, for example 3. For example, the longitudinal extension of the film hinge between the housing and the cover is therefore three times the distance between the connection point at which the film hinge is connected to the front wall of the housing and the first edge about which the film hinge is to be pivoted in order to close the cover.

Advantageously, the second base portion, by means of which the film hinge is connected to the cover, is connected to a front wall of the cover. In the process, it is not necessarily required for a connection point at which the second base portion is connected to the front wall of the cover to be at a distance from the edges of the front wall. In particular, the front wall of the cover can transition into the second base portion of the film hinge such that a risk of breakage at the transition between the film hinge and the front wall of the cover is reduced to the greatest possible extent.

On a side which faces away from the front wall supporting the film hinge, the cover preferably has an actuation lug to release the cover out of the closed position. This actuation lug is, for example, constructed in the style of a protrusion which, in the closed position of the cable marker, protrudes outwards over a housing box of the housing such that it can be taken hold of and activated manually by a user in order to release the cover out of its closed position and to open the cable marker. Due to the production of the cable marker, such an actuation lug may need to be of a more rigid material because, due to the increased rigidity of the material, warping and deformation of the cable marker is intrinsically not readily possible and therefore a release of the cover out of the closed position cannot be achieved readily, or at least not in a convenient manner, by deformation of the housing. Using the actuation lug, the cover can thus be opened in a simple manner without the housing having to be deformed in order to do so.

The housing preferably has a housing box that surrounds the accommodating opening, the housing box being formed, for example, by front walls attached to the viewing surface and side walls, which extend in an angled manner towards the viewing surface and form a box around the accommodating opening of the housing at the viewing surface. In the process, a locking protrusion is provided on the housing box, in particular on an edge of the housing box remote from the viewing surface, and protrudes inwards towards the accommodating opening and can mesh with the cover in an interlocking manner. To close, the cover is positioned on the housing and pressed into the accommodating opening of the housing until the locking protrusion engages behind the cover and thus stays interlocking on the housing. In the process, the locking protrusion, which is preferably formed integrally with the housing, is designed to be relatively thin and is therefore sufficiently flexible so that the cover can be moved past the locking protrusion by deforming the locking protrusion in order to engage the cover so as to interlock with the locking protrusion.

The housing preferably has at least one fixing device to fix to a cable. Such a fixing device can, for example, be formed by one or more fastening lugs on the housing through which, for example, a cable tie can be passed in order to fix the cable marker to an associated cable by means of the cable tie. Such a fixing device can also, however, already implement a cable tie such that in such a case, a cable tie is integrated integrally into the cable marker and therefore direct fixing to a cable is possible. It is likewise feasible to form the fixing device, for example, by clip elements by means of which the cable marker can be fixed in a clipping manner positively to a cable.

The cable marker preferably extends in the closed position along a longitudinal extension. The cable marker is therefore elongated and in particular is suitable for accommodating elongated labels such as tags or similar. In the process, the film hinge is arranged, for example, at one end of the cable marker which is at a distance from another end of the cable marker along the longitudinal extension. The film hinge is therefore located at a narrow side of the cable marker.

In the process, the cable marker is advantageously to be arranged with its longitudinal extension along a longitudinal extension of the cable. The longitudinal extension of the cable marker and the longitudinal extension of the cable therefore extend parallel to one another.

The cable marker is preferably produced from plastics material by means of plastics injection moulding. In the process, the cable marker is preferably produced in a position in which the cover is not positioned on the housing and is therefore not closed. Instead, the cover is preferably pivoted about 180° to the housing during production and is therefore in an open position in which the film hinge extends in a straight line between the cover and the housing and is therefore not loaded flexibly.

In the process, for production by means of plastics injection moulding, the accommodating opening of the housing and an inside of the cover face an ejector side of a plastics injection moulding tool, i.e. a side of the injection moulding tool on which suitable ejector tools act to eject the formed moulded part. The viewing surface of the housing and an outside of the cover opposite the inside, on the other hand, face an injection side of the injection moulding tool. In order to achieve the situation where the injection side of the injection moulding tool can easily be released from the housing and from the cover during demoulding of the moulded part formed by means of plastics injection moulding, but the moulded part with the housing and the cover initially stick to the ejector side of the injection moulding tool, one or more elevations and/or recesses are preferably applied to the inside of the cover facing the ejector side of the injection moulding tool, for example in the form of ribs, which provide an irregularity on the inside of the cover and therefore increase the adhesion of the cover on the ejector side of the injection moulding tool. Using appropriate ejector tools, the moulded part with its housing and cover can then be demoulded out of the tool and ejected.

Because by providing a (ribbed) structure on the cover it is ensured that the cover also sticks to the ejector side of the injection moulding tool during demoulding from an injection moulding tool, the cover can be prevented in particular from sticking to the injection side when removing the tool halves that make up the ejector side and the injection side from one another, which could otherwise lead to the film hinge tearing.

The cable marker is, as already described, preferably produced integrally by means of plastics injection moulding. Different materials can be considered in the process for producing the cable marker. Plastics materials which have a high transparency and do not appear milky are preferred in the process. Depending on the field of application of the cable marker, a plastics material is selected in the process that can meet the requirements determined by the field of application. If, for example, the cable marker is to be used in an environment with higher fire prevention requirements, for example in a rail vehicle, then a polycarbonate (PC) can be used. If the cable marker is to be used, for example, in outside applications with higher requirements for weather resistance, a polyamide (PA) can be used. Such plastics materials can have a relatively high modulus of elasticity (E-modulus), for example a modulus of elasticity greater than 1000 MPa or even greater than 1500 MPa.

Preferably, the plastics material is highly transparent with a transparency ($n_D$) greater than 80%, preferably greater than 85%. The cable marker is therefore see-through such that a label arranged in the accommodating opening of the cable marker is easy to read from the outside.

FIG. 1A, 1B to FIG. 3A to 3D show a first embodiment of a cable marker 1, which has a housing 2 and a cover 3 connected to the housing 2 by means of a film hinge 4. In the process, FIG. 1A, 1B to FIG. 3A to 3D show the cable marker 1 in an open position in which the cover 3 and the housing 2 have been pivoted about 180° relative to one another and are connected to one another along a longitudinal extension L. To close the cable marker 1, the cover 3 can be positioned onto the housing 2 in a closing direction S by bending the film hinge 4 such that in a closed position, an accommodating opening 23 bordered by the housing 2 is closed and a label, for example a tag or similar, inserted into the accommodating opening 23 is protected.

Figure 7:
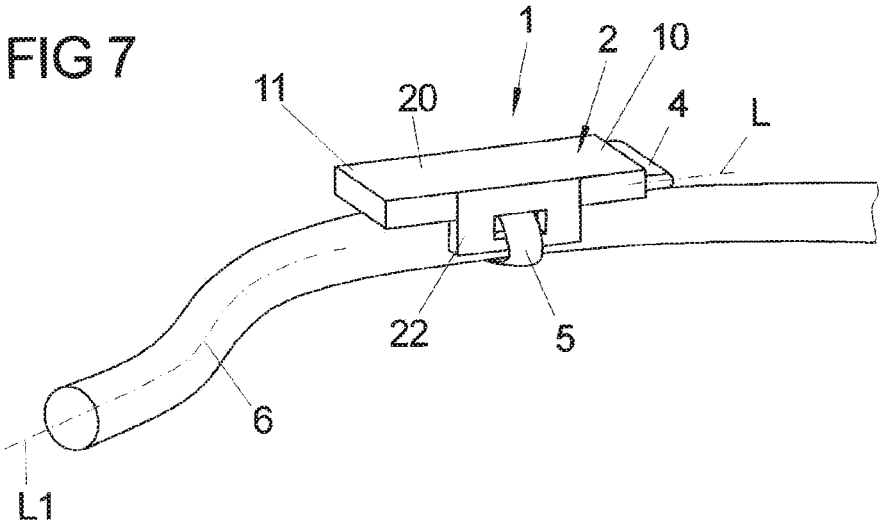
FIG. 7 is a schematic view of a cable marker arranged on a cable.

In the closed position, the cable marker 1 can then, as shown schematically in FIG. 7, be positioned on a cable 6 and, for example, be fixed to the cable 6 by means of a cable tie 5 engaging through a fastening lug 22, the housing 2 having a viewing surface 20 on a side facing away from the cable 6 through which a label inserted into the accommodating opening 23 of the housing 2 is visible. In the case of a cable marker 1 positioned on the cable 6, the cover 3 comes to rest between the housing 2 and the cable 6 such that when the cable marker 1 has been positioned, the cover 3 cannot be opened.

Figure 1A:
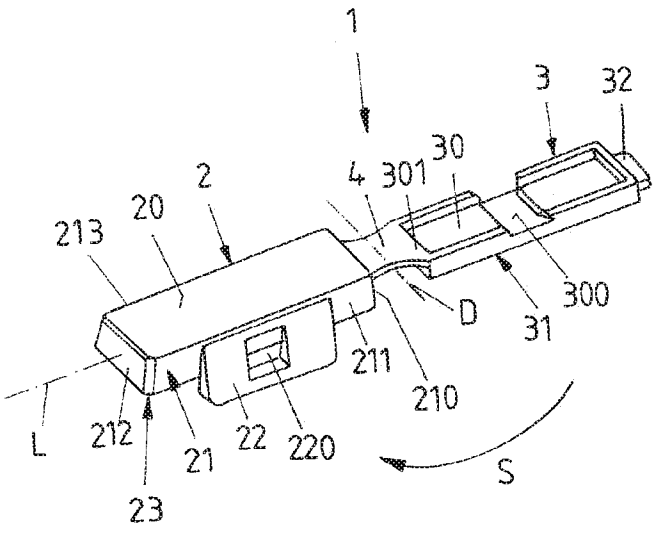
FIG. 1A is a perspective view of a cable marker.

As described, the housing 2 has a viewing surface 20 which is designed to be see-through and borders the accommodating opening 23 towards the exterior. A housing box 21 is attached to the viewing surface 20, as can be seen in FIG. 1A and 1B, and is formed by front walls 210, 212 and lateral walls 211, 213 which are each angled towards the viewing surface 20 and surround the accommodating opening 23. A fastening lug 22 is attached to each of the lateral walls 211, 213, each fastening lug 22 having an opening 220 through which a cable tie 5 for fixing the cable marker 1 to a cable 6 can be passed.

The cover 3, which is connected to the housing 2 by means of the film hinge 4, has an inside 31, which points to the accommodating opening 23 in the closed position of the cable marker 1, while an outside 30 opposite the inside 31 points to the cable 6 in the case of a cable marker 1 fixed to a cable 6. On the inside 31, the cover 3 has a ribbed structure which is formed by a peripheral ribbed ring 310 and a rib 311 extending transverse to the longitudinal extension L over the inside 31. When demoulding the cable marker 1, which has been produced by means of plastics injection moulding, out of an injection moulding tool, the ribbed structure, which provides irregularities on the inside 31 of the cover 3, serves to ensure that both the housing 2 and the cover 3 stick to an ejector side of a tool mould such that during the separation of two halves of the injection moulding tool from one another, tearing of the film hinge 4 is prevented as far as possible.

On the outer side 30 the cover 3 has a recess 300, which extends transverse to the longitudinal extension L over the outer side 30 of the cover 3 and in the closed position of the cable marker comes to rest in the region of the openings 220 of the fastening lugs 22 of the housing 2 such that a cable tie 5 can easily be passed through the openings 220 without being hindered by the cover 3.

On the side remote from the film hinge 4, the cover 3 has a actuation lug 32, which protrudes outwards over the front wall 212 of the housing 2 in the closed position such that the cover 3 can be opened from its closed position by applying pressure to the actuation lug 32.

Figure 2A:
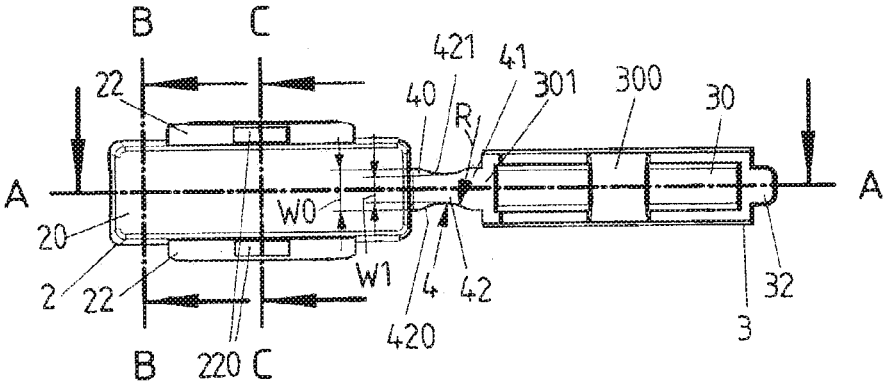
FIG. 2A is a plan view onto the cable marker in an open position.
Figure 2B:
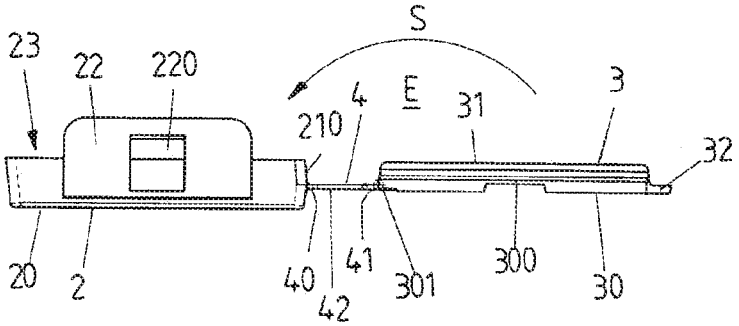
FIG. 2B is a side view of the cable marker according to FIG. 2A.
Figure 3A:
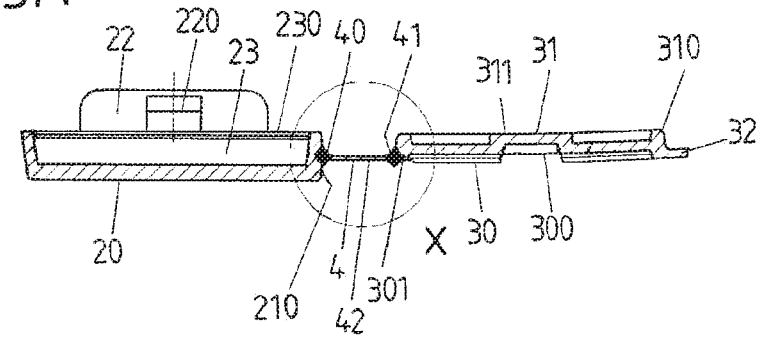
FIG. 3A is a sectional view along the line A-A according to FIG. 2A.
Figure 3B:
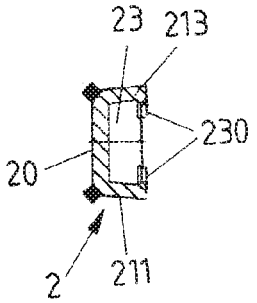
FIG. 3B is a sectional view along the line B-B according to FIG. 2A.
Figure 3C:
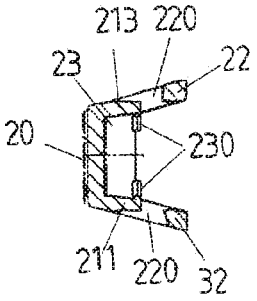
FIG. 3C is a sectional view along the line C-C according to FIG. 2A.
Figure 3D:
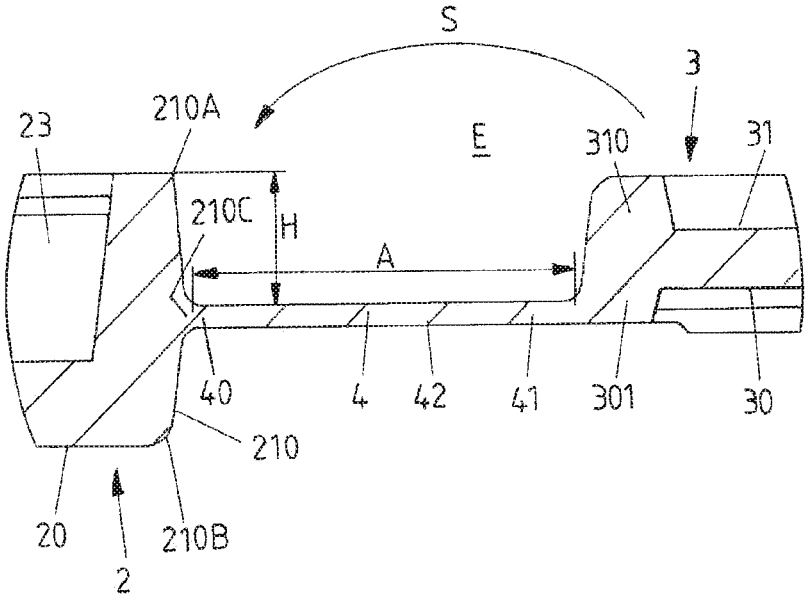
FIG. 3D is an enlarged view of the detail X according to FIG. 3A.
Figure 4A:
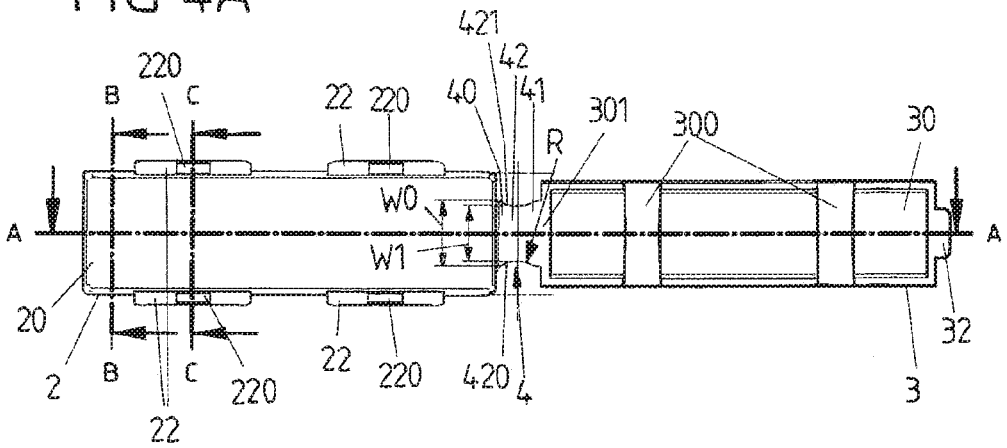
FIG. 4A is a plan view onto another embodiment of a cable marker.
Figure 4B:
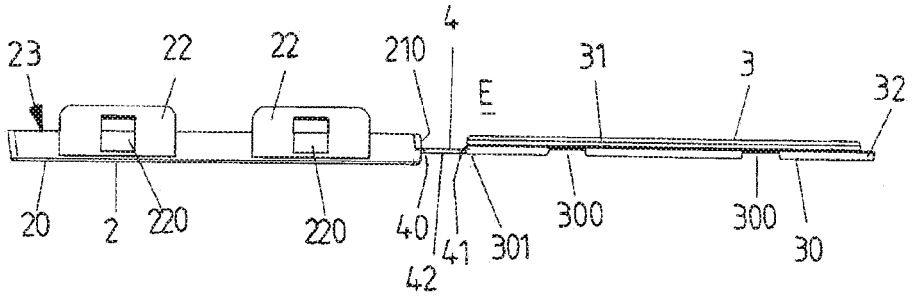
FIG. 4B is a side view of the cable marker according to FIG. 4A.
Figure 5A:
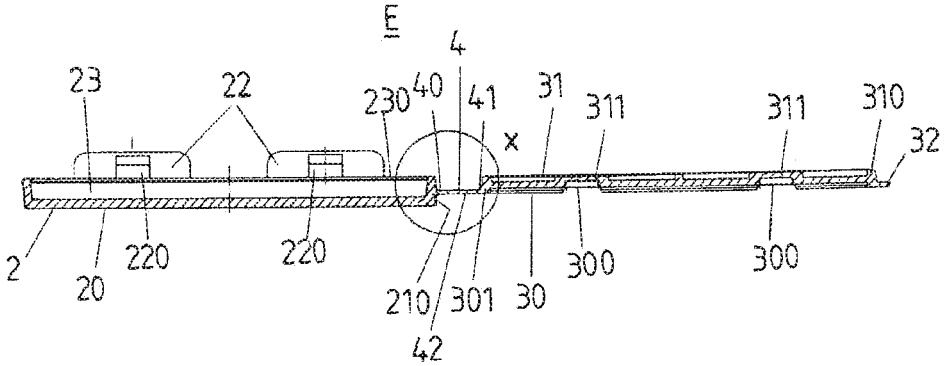
FIG. 5A is a sectional view along the line A-A according to FIG. 4A.
Figure 5B:
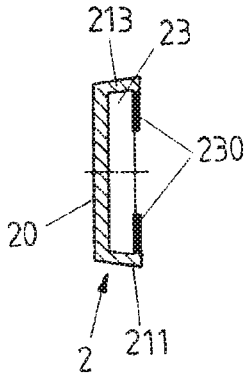
FIG. 5B is a sectional view along the line B-B according to FIG. 4A.
Figure 5C:
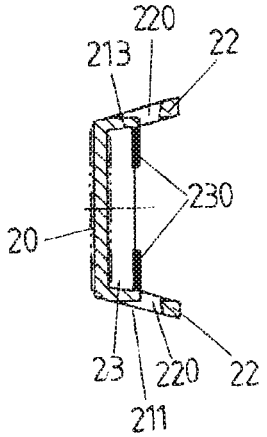
FIG. 5C is a sectional view along the line C-C according to FIG. 4A.
Figure 5D:
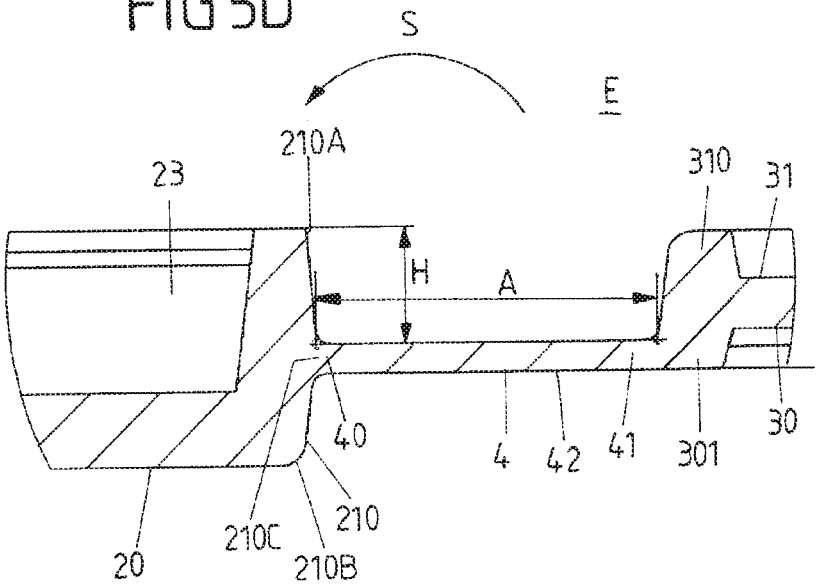
FIG. 5D is an enlarged view of the detail X according to FIG. 5A.

The film hinge 4 closes, as can be seen from FIG. 2A in conjunction with FIG. 3D, with a first base portion 40 on the front wall 210 of the housing 2 and with a second base portion 41 on a front wall 301 of the cover 3. A connecting portion 42 extends between the base portions 40, 41, in the region of which connecting portion the film hinge 4 is bent when pivoting the cover relative to the housing 2, in particular to close the cable marker 1 such that the film hinge 4 has to have sufficient elasticity in particular in the region of its connecting portion 42 to allow a pivoting of the cover 3 out of the open position into the closed position relative to the housing 2.

The connecting portion 42 extends with its lateral edges 420, 421 between the first base portion 40 and the second base portion 41 and therefore between the housing 2 and the cover 3. In the process, the connecting portion 42 is designed so as to be tapered and moreover is curved at its edges 420, 421 such that a curve with a constant, finite radius of curvature R emerges and the connecting portion 42 is therefore notched on both sides in a concave manner. In this manner, the width W1 of the connecting portion 42 relative to the width W0 of the base portions 40, 42 is reduced such that the elasticity of the film hinge 4 is increased in particular centrally at the connecting portion 42.

There arises a ratio of the width W1 of the connecting portion 42 at its narrowest point to the width W0 of the base portions 40, 41 of, for example, between 50% and 90%, preferably between 65% and 85%, for example between 70% and 80%.

By means of the film hinge 4 formed integrally with the housing 2 and the cover 3, the cover 3 can be pivoted along a pivoting plane E (equivalent to the drawing plane in FIG. 2B), a defined bending line D ensuing approximately, centrally on the film hinge 4, due to the tapering of the connecting portion 42 of the film hinge 4.

As can be seen in FIG. 3D, the first base portion 40 of the film hinge 4 is connected to the front wall 210 at a connection point 210C. In the process, the connection point 210C is located between edges 210A, 210B of which a first edge 210A is remote from the viewing surface 20 of the housing 2 and a second edge 210B constitutes the transition between the front wall 210 into the viewing surface 20. In the process, the connection point 210C is arranged roughly centrally between the edges 210A, 21B on the front wall 210, a distance H between the first base portion 40 and the first edge 210A arising, which is roughly equivalent to the distance between the first base portion 40 and the second edge 210B.

Because the connection point 210C is arranged between the edges 210A, 210B, no predetermined breaking point is generated between the film hinge 4 and the front wall 210, in particular at the front wall 210 such that the risk of the film hinge 4 snapping at the connection point 210C is reduced. The risk of snapping is further reduced in that the transition between the first base portion 40 and the front wall 210 is provided with a curve, as can be seen from FIG. 3D, and therefore a curved, constant transition is provided between the first base portion 40 and the front wall 210.

To close the cover 3, the cover 3 must be folded in the closing direction S towards the housing 2. To do this, the film hinge 4 must be conducted around the first edge 210A, which is inevitably associated with a bending of the film hinge 4 and therefore a flexible load on the film hinge 4. Because the connection point 210C is spaced away from the first edge 210A at a distance H, the bending load of the film hinge 4—as opposed to an arrangement of the connection point 210C directly on the first edge 210A—is, however, reduced, the longitudinal extension A of the film hinge 4 between the housing 2 and the cover 3 also being relatively long. Preferably, in the process, the ratio between the longitudinal extension A and the distance H is set at a value between 2 and 4, preferably between 2.5 and 3.5, for example 3.

Figure 6A:
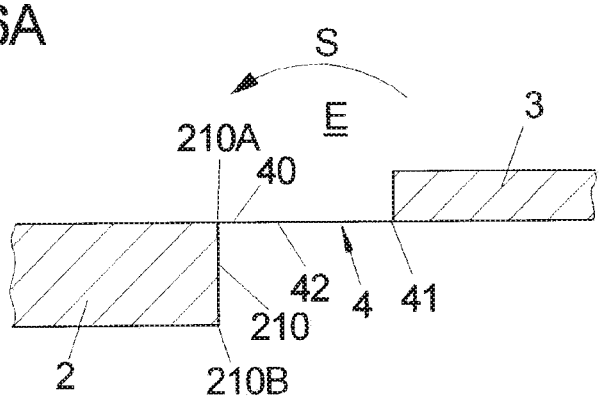
FIG. 6A is a schematic view of the connection of a film hinge to a front wall of a housing of a cable marker in a first embodiment.
Figure 6B:
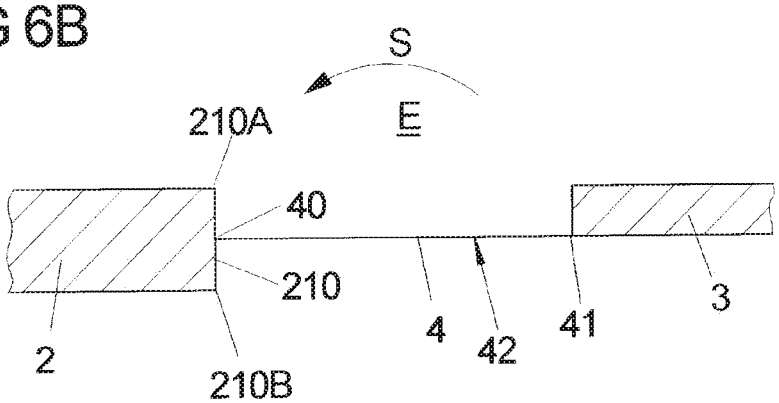
FIG. 6B is a schematic view of the connection of the film hinge to the front wall of the housing in a preferred, second embodiment.

The preferred arrangement of the film hinge 4 with the first base portion 40 at a distance from the first edge 210A is shown schematically again in FIG. 6A and 6B. While a predetermined breaking point is generated in the case of a direct arrangement of the film hinge 4 with the first base portion 40 on the first edge 210A of the front wall 210, as shown in FIG. 6A, and also a relatively small bending radius—which is associated with a large bending load of the film hinge 4—ensues when the cover 3 is pivoted in the closing direction S towards the housing 2, the connection of the film hinge 4 in the embodiment according to FIG. 6B is improved due to the distance of the first base portion 40 from the first edge 210A. In the closed position in the case of the embodiment according to FIG. 6B, a larger bending radius arises at the film hinge 4, the film hinge 4 being longer in order to allow the cover 3 to pivot in about the first edge 210A and simultaneously to further reduce the bending load of the film hinge 4 in the closed position.

In the proposed embodiment with a tapered connecting portion 42, bending also preferably takes place in the region of the connecting portion 42, which further reduces the bending load at the transition point to the front wall 210.

The second connecting portion 42 is connected to a front wall 301 of the cover 3 and in the process transitions constantly into the thick-walled front wall 301 such that due to the continual, constant transition, the generation of a predetermined breaking point between the film hinge 4 and the cover 3 is prevented.

As can be seen from FIG. 3B and 3C, a locking protrusion 230 is arranged on each of the side walls 211, 213 of the housing 2 on the inside and projecting towards the accommodating opening 23, with which locking protrusions the cover 3 can be engaged in a locking manner to close the cable marker 1 such that the locking protrusion 230 engages behind the cover 3 on its outside 30 in the closed position of the cable marker 1 and therefore holds the cover 3 in an interlocking manner on the housing 2. An identical locking protrusion is also arranged on the inside on the front wall 212, but not on the front wall 210, using which the cover is connected to the housing 2 by means of the film hinge 4.

The embodiment according to FIG. 4A, 4B to FIG. 5A to 5B is essentially identical to the preceding embodiment described and differs from the preceding embodiment essentially in that two fastening lugs 22 each with an opening 220 are provided on the housing 2 on each side wall 211, 213 in order to thus allow a fixing of the cable marker 1 to an associated cable 6 using two cable ties 5. Accordingly, two recesses 300 are provided on the outside 30 of the cover 3 and come to rest in the region of the openings 220 of the fastening lugs 22 in the closed position of the cable marker 1 and therefore allow the cable ties 5 to be passed through.

Apart from this, the embodiment is identical in function to the preceding embodiment described so that full reference should be made to the preceding explanation.

In principle, more fastening lugs 22, for example three fastening lugs 22 on each side wall 211, 213, are also feasible in the case of other embodiments. The number of fastening lugs 22 can be made dependent on the dimensions of the cable marker 1 and its length along the longitudinal extension L.

In this connection, it should be noted that essentially fixing devices other than the fastening lugs 22 shown can also be used. For example, cable ties can also be formed integrally with the housing 2 and/or the cover 3. Or fixing devices in the manner of clip devices can be used, by means of which the cable marker 1 can be fixed by means of clips to a cable 6.

FIG. 7 schematically shows a cable marker 1 in a position fixed to a cable 6. In the process, the cable marker extends along its longitudinal extension L, the film hinge 4 being arranged at a first end 10 of the cable marker 1, which is at a distance from a second end 11 of the cable marker 1 along the longitudinal extension L, for connecting the cover 3 to the housing 2. In the process, the longitudinal extension L extends at least in the region of the cable marker 1 substantially parallel to a longitudinal extension L1 of the cable 6 such that the cable marker 1 is arranged longitudinally along the cable 6.

The idea underlying the invention is not limited to the embodiments described above but can in principle also be realised in quite different embodiments.

A cable marker of the type described here can, for example, be produced from plastics material by means of plastics injection moulding, the cable marker being produced integrally, for example, from polycarbonate, polyamide or polyethylene. Depending on the field of application of the cable marker outside or in an environment that imposes special requirements for fire prevention, a suitable plastics material can be selected that meets the requirements imposed.

As a result of the special configuration of the cable marker, in particular with its film hinge, the use of relatively rigid plastics materials is also possible. This allows firstly the use of the cable marker in quite different fields of application and secondly production from a highly transparent material with a transparency of $n_D$>80%, in particular >85%.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 cable marker
10, 11 end
2 housing
20 viewing surface
21 housing box
210, 212 front wall
210A, 210B edge
210C connection point
211, 213 side wall
22 fastening lug
220 opening
23 accommodating opening
230 locking protrusion
3 cover
30 outside
300 recess
301 front wall
31 inside
310, 311 ribs
32 actuation lug
4 film hinge
40, 41 base portion
42 connecting portion
420, 421 edge
5 connecting element
6 cable
A length
D bending line
E pivoting plane
H distance
L, L1 longitudinal extension
R bending radius
S closing direction
W0, W1 width

The invention claimed is:

1. A cable marker comprising:

a housing which has an accommodating opening configured to accommodate a label for marking a cable;

a cover configured to dose the accommodating opening in a closed position of the cable marker; and a film hinge integrally connecting the housing to the cover such that in an open position, in which the cover does not close the accommodating opening, the cover is pivotable in relation to the housing along a pivoting plane, wherein the film hinge has a first base portion connecting the film hinge to the housing, a second base portion connecting the film hinge to the cover, and a connecting portion arranged between the first base portion and the second base portion, wherein the connecting portion has a width that is reduced in comparison with at least one of the base portions as viewed in a direction perpendicular to the pivoting plane, wherein the cable marker extends in the closed position along a longitudinal extension and the film hinge connects the housing and the cover to one another at a first end of the cable marker at a distance from a second end of the cable marker along the longitudinal extension, and wherein the cable marker is arranged with its longitudinal extension along longitudinal extension of the cable.

2. The cable marker of claim 1, wherein the width of the connecting portion is smaller than a width of the first base portion and of the second base portion.

3. The cable marker of claim 2, wherein a ratio of the narrowest width of the connecting portion to the width of at least one of the first base portion or the second base portion is between 50% and 90%.

4. The cable marker of claim 1, wherein the connecting portion extends transverse to the pivoting plane and has a first edge and a second edge, wherein the first edge and the second edge each extend between the first base portion and the second base portion and are at a distance from one another viewed in a direction perpendicular to the pivoting plane, wherein at least one of the first or the second edge is curved.

5. The cable marker of claim 1, wherein the housing has a viewing surface and a front wall angled towards the viewing surface, wherein the film hinge is arranged with the first base portion on the front wall of the housing.

6. The cable marker of claim 5, wherein the front wall has a first edge and a second edge opposite the first edge, wherein the front wall is connected to the viewing surface along the second edge and the first base portion is connected to the front wall at a connection point between the first edge and the second edge.

7. The cable marker of claim 6, wherein the connection point is equidistant from the first edge and the second edge.

8. The cable marker of claim 6, wherein the cover is configured to be pivoted about the first edge for transfer into the closed position, wherein the connection point has a distance from the first edge and the film hinge has a longitudinal extension between the housing and the cover such that a ratio of the longitudinal extension to the distance is between 2 and 4.

9. The cable marker of claim 1, wherein the second base portion is connected to a front wall of the cover and the cover has an actuation lug on a side facing away from the front wall, the actuation lug being configured to release the cover out of the closed position.

10. The cable marker of claim 1, wherein the housing has a housing box surrounding the accommodating opening, wherein a locking protrusion, with which the cover is configured to engage in an interlocking manner in the closed position, is arranged on the housing box projecting inwards towards the accommodating opening.

11. The cable marker of claim 1, wherein the housing has at least one fixing device configured to fix to the cable.

12. The cable marker of claim 1, wherein the cable marker is produced integrally by plastics injection moulding.

13. The cable marker of claim 1, Wherein the cover has at least one of an elevation or a recess on an inside facing the accommodating opening of the housing in the closed position configured to generate an irregularity on the inside.

14. The cable marker of claim 1, wherein the cable marker comprises a plastics material containing at least one of polycarbonate or polyamide.

15. The cable marker of claim 14, wherein the plastics material has a modulus of elasticity greater than 1000 MPa.

16. The cable marker of claim 14, wherein the plastics material has a transparency greater than 80%.

* * * * *